US005509351A

United States Patent [19]

Kato

[11] Patent Number: 5,509,351

[45] Date of Patent: Apr. 23, 1996

[54] DYNAMICALLY BALANCED MECHANICAL PRESSING MACHINE

[75] Inventor: Heizaburo Kato, Shizuoka, Japan

[73] Assignee: Sankyo Seisakusho Co., Tokyo, Japan

[21] Appl. No.: 293,583

[22] Filed: Aug. 22, 1994

[30] Foreign Application Priority Data

Aug. 25, 1993 [JP] Japan ..... 5-210665

[51] Int. Cl.[6] ..... B30B 1/06

[52] U.S. Cl. ..... 100/282; 83/615

[58] Field of Search ..... 100/214, 280, 100/282, 292; 72/451, 452; 74/49, 55, 589, 590, 591, 603, 604; 83/615, 628

[56] References Cited

U.S. PATENT DOCUMENTS

| | | | |
|---|---|---|---|
| 2,321,325 | 6/1943 | Sherman et al. | 83/615 |
| 4,375,785 | 3/1983 | Schoch et al. | 100/214 |

FOREIGN PATENT DOCUMENTS

| | | | |
|---|---|---|---|
| 2806584 | 5/1984 | Germany . | |
| 8890008 U | 8/1990 | Germany . | |
| 52-80582 | 7/1977 | Japan . | |
| 679421 | 8/1979 | U.S.S.R. | 100/282 |
| 893571 | 1/1982 | U.S.S.R. | 100/214 |
| 1133115 | 1/1985 | U.S.S.R. | 100/282 |

*Primary Examiner*—Stephen F. Gerrity
*Attorney, Agent, or Firm*—Harness, Dickey & Pierce

[57] ABSTRACT

There is disclosed a mechanical pressing machine utilizing a crankshaft, in which an unbalanced inertia force produced during a reciprocal movement of a slider is canceled without producing a flexure in the whole of the pressing machine, thereby enhancing a dynamic precision. A balance weight, which is equivalent in weight to the slider vertically slidably supported on a frame, is slidably mounted on an upper portion of the slider for vertical sliding movement. The slider is driven through a first crankshaft and a connecting rod, and at the same time the balance weight is driven in a direction opposite to the direction of movement of the slider through a first gear fixedly mounted on the first crankshaft, a second gear, an intermediate shaft, flexible couplings, a second crankshaft and a connecting rod. As a result, an inertia force produced in the slider is canceled by an oppositely-directed inertia force of the balance weight.

4 Claims, 2 Drawing Sheets

DYNAMICALLY BALANCED MECHANICAL PRESSING MACHINE

BACKGROUND OF THE INVENTION

This invention relates generally to a mechanical pressing machine, and more particularly to a mechanical pressing machine provided with a dynamic balancing device for balancing an unbalanced inertia force produced in a reciprocally-moving mechanism utilizing a crankshaft.

Generally, in a mechanical press utilizing a crankshaft, a slider is connected to an eccentric crank portion of the crankshaft through a connecting rod, thereby converting a rotational motion of the crankshaft into a reciprocal motion of the slider. When the operation of such a pressing machine utilizing the crankshaft is started, vibrations, resulting from an unbalanced inertia force due to the reciprocal movement of the slider, develop to produce noises and to cause a positional error. To avoid this, usually, a dynamic balancing device has been used.

In a conventional dynamic balancing device, an unbalanced inertia force of a reciprocating slider is canceled by a balance weight which is equivalent in weight to the slider, is mounted on a crankshaft, and is disposed 180° out of phase. With this construction, the unbalanced inertia force in the whole of the press is canceled by the balance weight, and vibrations of the press itself (except for the slider and the moving parts) are reduced, and the press can be operated at high speed.

In the above conventional pressing machine, however, although the unbalanced inertia force of the slider is canceled by the balance weight, the inertia force exerted on the slider during the reciprocal movement acts on both of the slider and the balance weight to increase the dynamic load, since the slider and the balance weight are separately supported on a frame. This increase of the inertia force causes a flexure in accordance with the spring constant of the crankshaft and the slider, and has adversely affected a dynamic precision such as a lower dead center precision and a coining precision.

SUMMARY OF THE INVENTION

With the above problems in view, it is an object of this invention to provide a mechanical pressing machine provided with a dynamic balancing device capable of achieving a high dynamic precision.

According to the present invention, there is provided a mechanical pressing machine wherein a slider, connected through a connecting rod to a crankshaft to which a rotational force of a motor is transmitted, is slidingly moved vertically relative to a frame; and a balance weight movable in a direction opposite to the direction of movement of the slider is slidably mounted on the slider.

Thus, in the pressing machine of the present invention, the balance weight is slidably mounted on the slide so as to move in a direction opposite to the direction of movement of the slider. With this construction, an unbalanced inertia force of the slider is canceled in the slider system, and a load fluctuation will not be imparted to the other portion.

Therefore, in the present invention, the inertia force (at least a vertical reciprocating movement) of the slider can be canceled without imparting a load to the other portion, thereby preventing the dynamic precision from being adversely affected.

DESCRIPTION OF THE PREFERRED EMBODIMENT

Figure 1:
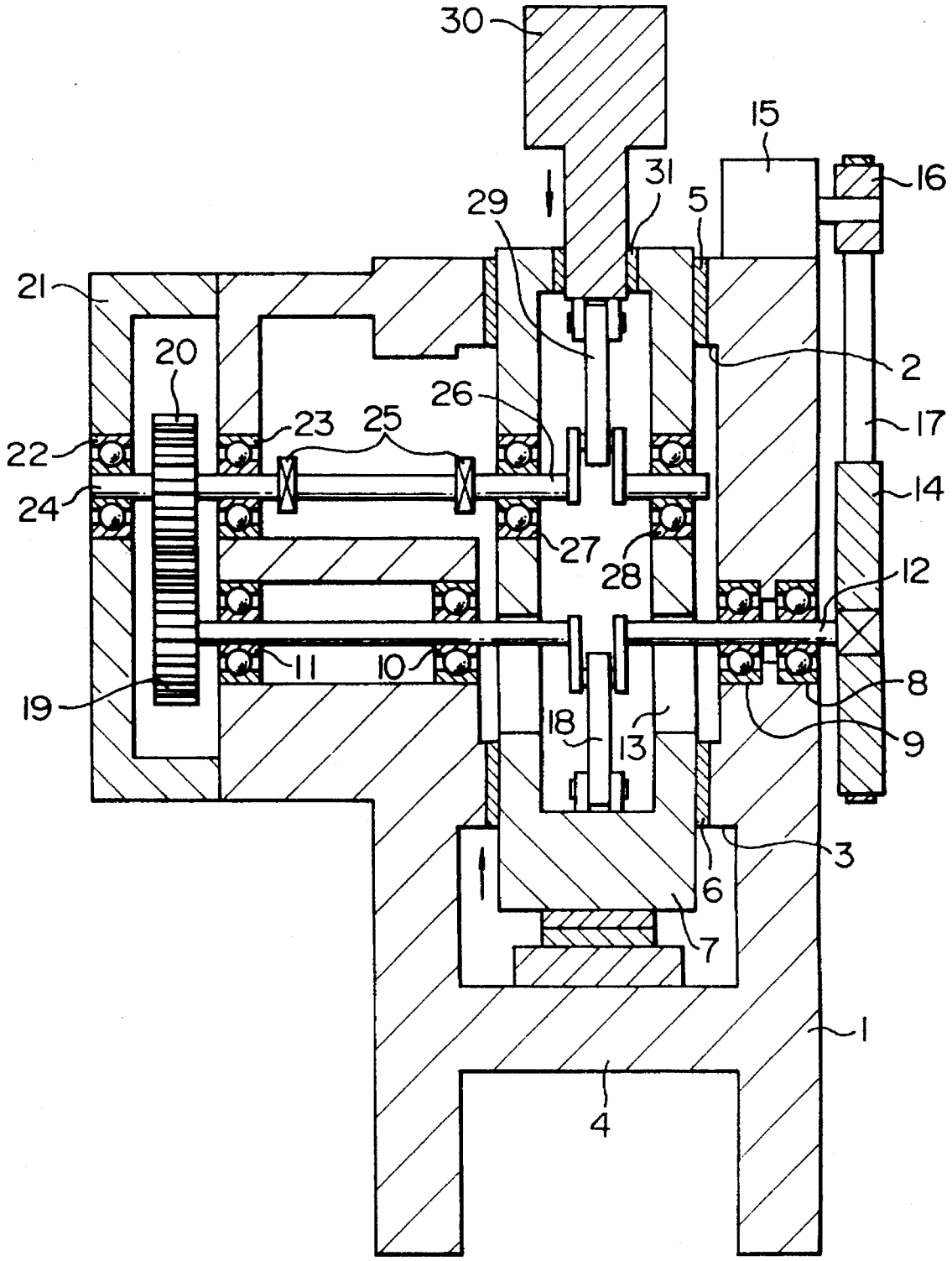
FIG. 1 is a schematic cross-sectional view of one preferred embodiment of a mechanical pressing machine of the present invention as viewed from a front side thereof.
Figure 2:
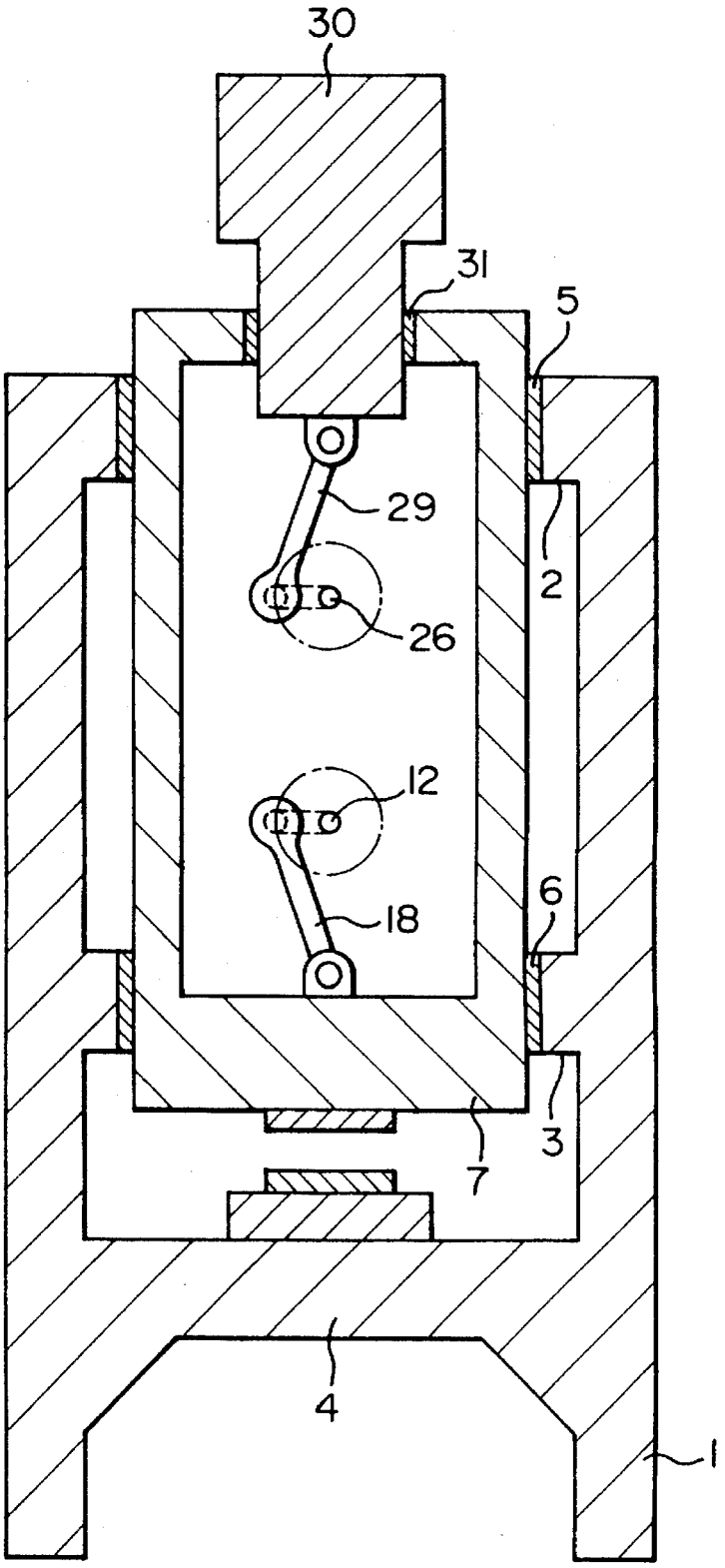
FIG. 2 is a schematic cross-sectional view of the pressing machine as viewed from a side thereof.

FIG. 1 is a schematic cross-sectional view of one preferred embodiment of a mechanical pressing machine of the present invention as viewed from a front side thereof, and FIG. 2 is a schematic cross-sectional view of the pressing machine as viewed from a side thereof. A frame 1 includes an upper support portion 2, an intermediate support portion 3, and a lower support portion 4. A slider 7 is supported through bearings 5 and 6 on the upper and intermediate support portions 2 and 3 for vertical sliding movement. The slider 7, having an upper press die mounted on its lower surface, has a rectangular shape as a whole, and is of a hollow construction. A first crankshaft 12 is rotatably mounted on the frame 1 through bearings 8, 9, 10 and 11, and extends through relief holes 13 formed in the slider 7. A flywheel 14 is fixedly mounted on one end of the first crankshaft 12, and is driven by a motor 15 through a pulley 16, fixedly mounted on a rotation shaft of the motor 15, and a belt 17 extended around the pulley 16 and the flywheel 14, the motor 15 being mounted on the top of the frame 1. The slider 7 is connected through a connecting rod 18 to a crank portion of the first crankshaft 12 disposed intermediate the opposite ends of the crankshaft 12. A first gear 19 is fixedly mounted on the other end of the first crankshaft 12. A second gear 20 equal in diameter to the first gear 19 is in mesh with the first gear 19, and the second gear 20 is fixedly mounted on an intermediate shaft 24 rotatably supported on a gear cover 21 and the frame 1 through bearings 22 and 23. The intermediate shaft 24 is connected to a second crankshaft 26 through flexible couplings 25, and the second crankshaft 26 is rotatably supported on the slider 7 through bearings 27 and 28. A balance weight 30 is connected through a connecting rod 29 to a crank portion of the second crankshaft 26 disposed intermediate the opposite ends of the second crankshaft 26. The crank portion of the second crankshaft 26 is equal in amount of eccentricity to the crank portion of the first crankshaft 12. The balance weight 30 is equivalent in weight to the slider 7, and is mounted through a bearing 31 on a central portion of an upper portion of the slider 7 for vertical sliding movement. The first gear 19, the second gear 20, the intermediate shaft 24, the flexible couplings 25, the second crankshaft 26, the connecting rod 29 and the balance weight 30 jointly constitute a dynamic balancing device.

The operation of the above mechanical pressing machine will now be described. When the motor 15 is rotated to transmit its rotational force to the flywheel 14 via the pulley 16 and the belt 17 to rotate the first crankshaft 12, the slider 7 moves upward from the illustrated lower dead center, and at the same time the balance weight 30 moves downward at the same speed through the first gear 19, the second gear 20, the intermediate shaft 24, the flexible couplings 25, the second crankshaft 26 and the connecting rod 29. As a result, an inertia force produced in the ascending slider 7 can be canceled by an oppositely-directed inertia force of the descending balance weight 30, and therefore a flexure to be produced in the whole of the pressing machine is reduced, thereby enhancing a dynamic precision.

As described above, in the present invention, the balance weight movable in a direction opposite to the direction of movement of the slider is mounted on the slider for vertical sliding movement, and with this construction an unbalanced inertia force produced during the reciprocal movement of the slider can be canceled in the slider system, and a flexure to be produced in the whole of the pressing machine can be reduced, and therefore the dynamic precision can be enhanced, and also vibrations and noises can be reduced.

What is claimed is:

1. In a mechanical pressing machine wherein a slider, connected through a connecting rod to a crankshaft to which a rotational force of a motor is transmitted, is slidingly moved vertically relative to a frame;

the improvement comprising a balance weight, support means connected to said slider for supporting said balance weight on said slider for slidable movement on said slider in a direction opposite to the direction of movement of said slider whereby the inertia force of said balance weight is opposite to the inertia force of said slider and is applied substantially directly to said slider.

2. The mechanical pressing machine of claim 1 further comprising:

said slider being of a hollow construction supported on said frame for vertical sliding movement, a first crankshaft rotatably mounted on said frame, said first crankshaft having a first crank portion connected to said slider for imparting reciprocal motion thereto;

a second crankshaft having a second crank portion connected to said balance weight for imparting reciprocal motion thereto.

3. A mechanical pressing machine comprising:

a slider of a hollow construction supported on a frame for vertical sliding movement, said slider having an upper press die mounted on its lower surface;

a first crankshaft rotatably mounted on said frame and extending through said slider, one end of said first crankshaft being connected to rotation transmission means, and said first crankshaft having a crank portion intermediate opposite ends thereof which crank portion is connected to said slider through a connecting rod;

a first gear fixedly mounted on the other end of said first crankshaft;

an intermediate shaft rotatably mounted on said frame;

a second gear fixedly mounted on said intermediate shaft, said second gear being in mesh with said first gear;

a second crankshaft rotatably mounted on said slider, said second crankshaft being connected at one end thereof to said intermediate shaft through a flexible coupling, and said second crankshaft having a crank portion; and a balance weight received in an upper portion of said slider for vertical displacement relative to said slider, said balance weight being connected to said crank portion of said second crankshaft through a connecting rod.

4. A mechanical pressing machine according to claim 3, in which said crank portions of said first and second crankshafts are equal in amount of eccentricity to each other, and are disposed 180° out of phase with each other, and said first and second gears have the same diameter.

* * * * *